US010953291B2

(12) United States Patent
Savard

(10) Patent No.: US 10,953,291 B2
(45) Date of Patent: Mar. 23, 2021

(54) METHOD OF PRODUCING AN AERIAL PROJECTILE FOR RACKET SPORT TRAINING/PRACTICE OR AMUSEMENT PURPOSES

(71) Applicant: Daniel G. Savard, Winnipeg (CA)

(72) Inventor: Daniel G. Savard, Winnipeg (CA)

(73) Assignee: Hecs Ball Inc., Winnipeg (CA)

( * ) Notice: Subject to any disclaimer, the term of this patent is extended or adjusted under 35 U.S.C. 154(b) by 11 days.

(21) Appl. No.: 16/418,349

(22) Filed: May 21, 2019

(65) Prior Publication Data

US 2020/0155907 A1 May 21, 2020

Related U.S. Application Data

(60) Provisional application No. 62/768,468, filed on Nov. 16, 2018.

(51) Int. Cl.

| | |
|---|---|
| ***A63B 45/00*** | (2006.01) |
| ***D04D 7/06*** | (2006.01) |
| ***A63B 43/00*** | (2006.01) |
| *A63B 102/04* | (2015.01) |

(52) U.S. Cl.

CPC ..... *A63B 45/00* (2013.01); *A63B 43/002* (2013.01); *A63B 2102/04* (2015.10); *A63B 2209/00* (2013.01); *D04D 7/06* (2013.01)

(58) Field of Classification Search

CPC ..... A63B 43/002; A63B 45/00; A63B 43/00; A63B 2043/001; D04D 7/06; D04D 7/10; A01K 15/026

USPC ..... 428/4–5; 119/707, 709; 473/569, 573, 473/575, 576

See application file for complete search history.

(56) References Cited

U.S. PATENT DOCUMENTS

| | | | | |
|---|---|---|---|---|
| 1,548,531 A | | 8/1925 | Knight | |
| 2,484,475 A | * | 10/1949 | Studer | A63B 67/183 473/575 |
| 3,591,904 A | * | 7/1971 | Rosene | D04D 7/06 28/147 |
| 3,833,157 A | * | 9/1974 | Lofton | A41G 1/02 223/46 |

(Continued)

OTHER PUBLICATIONS

Steven Boga, "Badminton: A handbook of all the rules, strategies, tips, and techniques that you need to be a better player", published by Stackpole Books, 1996, pp. 64-66 (Year: 1996).*

*Primary Examiner* — Laura Davison

(74) *Attorney, Agent, or Firm* — Kyle R Scatterthwaite; Michael R Williams; Ade & Company Inc

(57) ABSTRACT

A training/practice/amusement projectile comprises a ball with optimal baffling and rebounding characteristics for play and training of hand-eye coordination and motor skills. The ball generally includes a combination of bounce and baffling elements. In one embodiment the bounce and baffling elements respectively comprise densely packed loops of filament, and individual filament strands of lesser density, both radiating from a core of the ball. A novel method of fabrication includes winding wider and narrower loops of filament, bundling same together at a cinched core, and then cutting the wider loops to form the strands radiating outward inched core to impart a generally spherical outer shape to the ball.

5 Claims, 12 Drawing Sheets

(56) References Cited

U.S. PATENT DOCUMENTS

| | | | | | |
|---|---|---|---|---|---|
| 3,854,179 | A | * | 12/1974 | Montoya | D04D 7/08 28/147 |
| 4,133,533 | A | * | 1/1979 | Doyle | A63B 67/187 473/575 |
| 4,756,529 | A | | 7/1988 | Stilinger | |
| 4,884,807 | A | * | 12/1989 | Welch | A63B 43/00 473/575 |
| 5,186,457 | A | | 2/1993 | Cole | |
| D728,713 | S | | 5/2015 | Philips | |
| 2007/0270233 | A1 | | 11/2007 | Ruston | |

* cited by examiner

METHOD OF PRODUCING AN AERIAL PROJECTILE FOR RACKET SPORT TRAINING/PRACTICE OR AMUSEMENT PURPOSES

CROSS-REFERENCE TO RELATED APPLICATIONS

This application claims benefit under 35 U.S.C. 119(e) of U.S. Provisional Application No. 62/768,468, filed Nov. 16, 2018, the entirety of which is incorporated herein by reference.

FIELD OF THE INVENTION

This invention pertains to a sport projectile, and more particularly, a projectile to be struck or thrown/caught by a limb or piece of sporting equipment.

BACKGROUND

Both to younger individuals who are just developing hand-eye coordination and motor control, and to veteran athletes looking for more ways to practice at a faster pace, it is often difficult to practice an isolated movement by one's self, due to the unavailability of activity partners or because of the full speed of a particular sport. Practicing by one's self may also be less effective due to being reliant on one's own feedback and minimizing training protocol and drill options.

For example, one of the problems with racket sports is that they need specialized equipment to play and practice, which includes a court or specialized playing surface. As a more specific example, badminton is difficult to practice by one's self and cannot be performed continuously without a feeding machine or training partner. A wall can often be used as a substitute for a hitting partner. A wall offers some desirable qualities, but a shuttlecock is not optimal for practicing against a wall. The main problems with badminton wall practice include: damage to walls if made from drywall or other softer materials other than concrete, damage to shuttlecock feathers due to erratic flight, unrealistic flight patterns making specific practice more difficult, undesirable noise for other individuals in the vicinity, and the need for a substantial amount of space for effective practice. In conclusion, one could not safely and effectively practice badminton skills in a typical home environment. Other similar projectiles, such as table-tennis balls, tennis balls, squash balls, and other training balls, do not perform adequately for badminton.

Another problem is that racket sports demand significant practice to attain mastery. Structured skill acquisition requires specific environments and guidance. One of the main drivers in skill acquisition in sports like badminton is time spent practicing hand-eye coordination and racket skills. Hand-eye coordination is essential to consistently make contact with a projectile in one's sport, especially when circumstances are more chaotic, less predictable. Racket skills are essential as a general ability, which includes the ability to rapidly change one's grip configuration on the racket, control the racket head for consistent and powerful shots, and finesse of movement for more intricate shots, including spinning and tumbling the projectile. Accordingly, there exists a need for a novel projectible well suited to at least partially overcome the forgoing challenges for novice and experienced racket sport athletes alike.

SUMMARY OF THE INVENTION

One object of the invention is to provide a training device with optimal baffling and rebounding characteristics.

Another object is to provide a training Ball that offers optimal baffling in the flight.

Another object is to provide a training ball that can rebound after impact on a surface or equipment.

Another object is to provide a training ball that is safe to use in confined spaces, and may be used against virtually any hard surface without damaging the surface.

Other objects and advantages of the various embodiments of the present invention will become obvious to the reader, and it is intended that these additional objects and advantages are within the scope of the present invention. To the accomplishment of the above and related objects, this invention may be embodied in the form illustrated in the accompanying drawings, attention being called to the fact, however, that the drawings are illustrative only, and that changes may be made in the specific construction illustrated and described within the scope of this application.

According to one aspect of the invention, there is provided a training/practice/amusement projectile device which has a substantially spherical configuration, and which is formed from a baffling material, such as a large plurality of filament/fabric/foam elements that radiate in a dense, bushy manner from a central core region to impart a substantially spherical ball shape to the device. The filaments/fabric or other baffling material are sufficiently soft and flexible to collapse on impact. A portion of soft, flexible material is arranged in a denser fashion to create a bounce element of lesser baffling effect to help contribute to a weight and reboundable character of the device. The baffling features promote slower flight, and contributes to noise reduction and cushioned non-damaging impact with a wall, other practice surface, sports racket, or user body part, such as a hand or other limb.

According to another aspect of the invention, there is provided a training/practice/amusement projectile device comprising a bounce element and a plurality of baffling elements, both of which radiate from a core of the device, said baffling elements contributing to a substantially spherical ball-shape of the device and said bounce element contributing areas of higher density than said baffling elements.

According to yet another aspect of the invention, there is provided a method of producing a training/amusement projectile device comprising:

(a) winding filament into a set of wider loops and another set of narrower loops;

(b) with the sets of loops bundled together in a singular bundle in which the set of narrower loops are nested inside the set of wider loops, cinching the sets of loops together at a central core of said singular bundle, from which both sets of loops each radiate outward in multiple directions; and (c) cutting only the wider loops, and not any of the narrower loops, of said singular bundle to create a plurality of individual baffling elements of lower density than a bounce element defined by the narrower loops, which are left intact.

BRIEF DESCRIPTION OF THE DRAWINGS

Preferred embodiments of the invention will now be described in conjunction with the accompanying figures in which.

DETAILED DESCRIPTION OF PREFERRED EMBODIMENTS

Embodiments of the present invention are directed to a ball-shaped amusement/practice/training projectile comprising a combination of bounce elements and baffling elements, fused or fastened together, as well as a method of fabricating such projectile.

Figure 20:
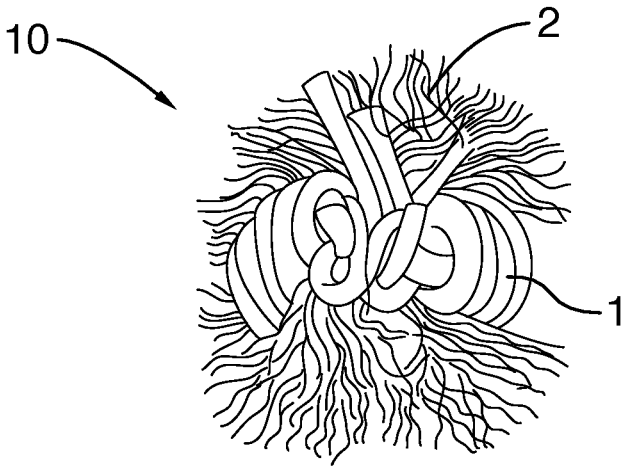
FIG. 20 illustrates the finished projectile after fanning and trimming, and optional subsequent fraying, of the flexible strands, at which point the intact uncut narrow loops form a dense bounce element radiating from the cinched core of the projectile, and the operationally frayed strands serve as less dense baffle elements radiating from the cinched core to impart the substantially spherical ball shape to the exterior of the projectile.
Figure 21:
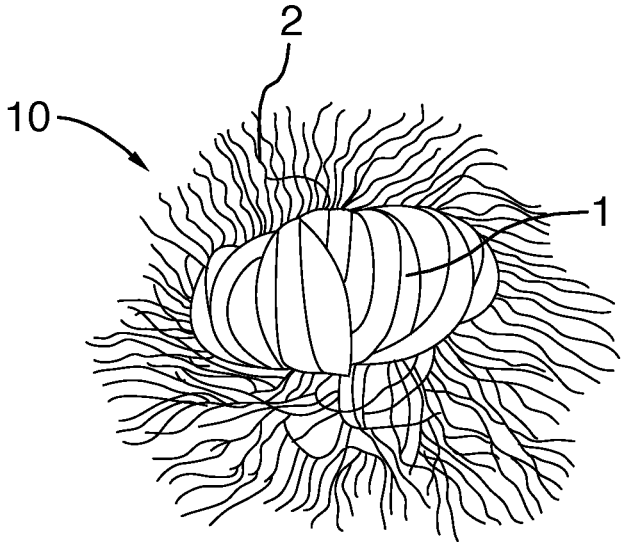
FIG. 21 is another view of the finished projectile of FIG. 20 from another side thereof.

With reference to the finished projectile shown in FIGS. 20 and 21, the bounce element in this particular embodiment comprises a plurality of intact loops that radiate from a central core of the ball, where these loops are bundled together in a cinched fashion.

The loops may vary in quantity between a small plurality or large plurality, for example ranging in number from 2 to 10,000 some embodiments, and more particularly between 2 and 400 loops in other embodiments. The intact loops contribute to the resulting density and bounce of the projectile. These intact loops are formed to create higher density areas in the projectile relative to the less dense baffling elements described herein further below. Embodiments with a higher proportion of loops will fly faster through the air due to less air resistance and structural density.

The intact loops may range in length from 0.2 cm to 10 cm in measure of their radial expanse from a central core of the projectile. A longer loop will contribute to more baffling, rather than bounce. Shorter loops are compact, thus transfer force more quickly, contributing to more bounce and less baffling.

In some embodiments, including the preferred embodiment shown in the figures, the intact loops may be adjacent and generally parallel to one another, forming a tight cluster oriented along a transverse axis of the ball, i.e. in parallel relation to a particular diameter line of the generally spherical ball-like outer shape of the projectile. In other embodiments, the intact loops may be distributed randomly throughout the strands of the ball that define the baffling elements of the projectile, as described in more detail below.

In the preferred embodiment of FIGS. 20 and 21, the bounce element is in the form of a looped and bundled filament, but in other embodiments can be of any element that offers sufficient bounce qualities. An alternative embodiment may include a bounce element of bubble-like shape which rebounds upon compression. That is, the bounce element may comprise a resilient gas-filled hollow bubble that is momentarily compressible or collapsible inwardly on itself, but that springs back into a normal default form once the impact or compression force is removed.

With continued reference to the preferred embodiment of FIGS. 20 and 21, the baffling elements in this instance are a plurality of soft flexible strands that radiate from the center core of the ball where the loops of the bounce element are bundled together. The strands may range in number from 2 to 10,000, and contribute to the baffling characteristic of the projectile. The number of individual strands selected may depend heavily on the materials used and the desired weight of the projectile. Strands may range in length from 0.2 cm to 10 cm in measure of their radial expanse from a central core of the projectile. In preferred embodiments, the size of the baffling material will give the projectile an overall size that closely models an existing corollary in sport, such as a tennis ball or badminton shuttlecock.

In preferred embodiments, the overall weight of the projectile closely imitates that of an existing corollary in sport, such as a tennis ball (57.7 g to 58.5 g) or badminton shuttlecock (4.75 g to 5.5 g). In other embodiments, the weight can range from 0.1 g to 1000 g.

The loops and strands are fused or fastened together at the center core of the ball. In the preferred embodiment of FIGS. 21 and 22, such fastening is accomplished by a center cinch in the form of a cord or tie that is tightly strung around the center of the bundled loops and strands. The cinch may be tied, for example, first by a double-looped knot on one side of the bundle to prevent slippage, followed by two single knots on the opposite side of the bundle.

The mass ratio of material can range from 100:1 to 1:100 of light baffling material to denser bounce material. In some embodiments, the ratio may typically range between 8:1 and 1:8, and in select preferred embodiments, the ratio may typically range between 4:1 and 1:4. In the preferred embodiment made from thread, examples may include 1 g of strands and 4 g of loops, or 4 g of strands with 0.5 g of loops.

As will become more apparent from the following description of a preferred method of fabrication for the projectile, the bounce element and baffling elements may be produced from a same singular length of filament as one another, which at some point in the fabrication process is cut in order to create the differently configured elements of the finished article, and as mentioned above and described in more detail below, are fastened or otherwise joined together in the middle. Alternative constructions may employ materials other than a thread filament or wider ribbon filament to produce one or both of the bounce and baffling elements. Such materials may for example include textiles, fabrics (including folded fabric, for example spiral or accordion folded), foam (including soft foam, denser foam, memory foam), tubular members, various soft materials, and others, whether natural or synthetic.

The main attribute of the materials is that they can be arranged in a ball, combining lower and higher density areas. The lower density material is primarily for cushioning/baffling, and the higher density material is primarily for rebounding and weight. In preferred embodiments, the invention is generally soft as to not damage a surface or user. Additional attributes may include manufacture of the projectile in different colors, whether by use of differently coloured materials for assembly, dye modified colouration of the projectile after assembly, or other colouration means; optional use of glow in the dark materials; and/or selection of high or low visibility materials, for example reflective or camouflage materials.

In use, the finished projectile is struck with a limb or other human body part, or a piece of equipment, such as a sporting racket. The invention can also be juggled, thrown or caught. The invention can be used against a wall or other suitable surface, but can also just be used in the air in one's personal space, whether indoors or outside.

Having described the general structure of the projectile, attention is now turned to a preferred method of its manufacture.

Figure 1:
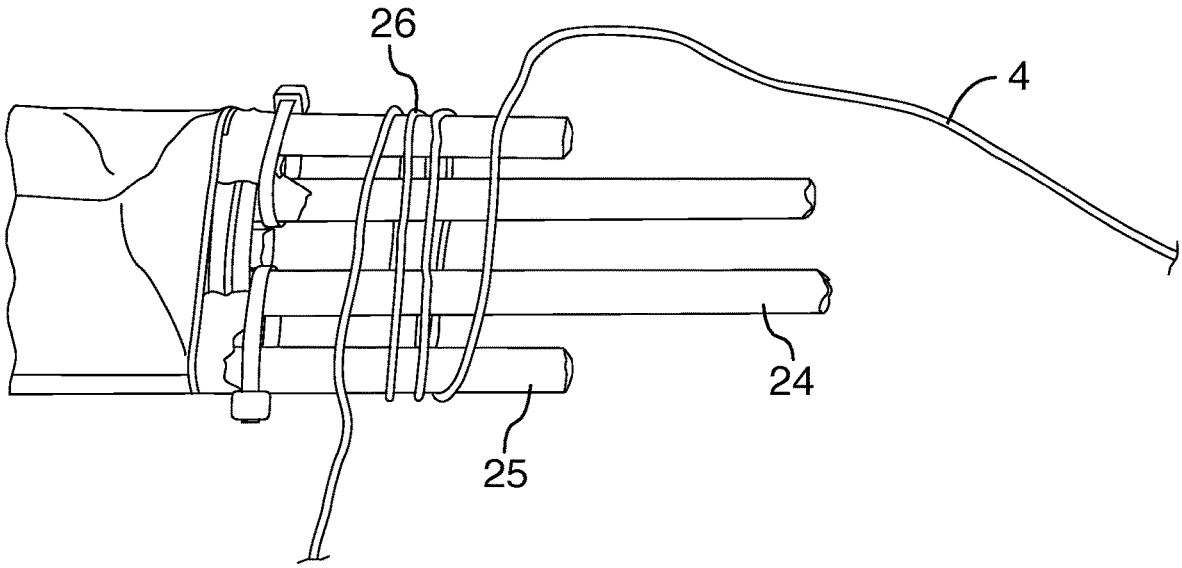
FIG. 1 shows a first stage of fabricating a projectile of the present invention, where a multi-forked implement is used to receiving initial windings of a filament around a wide fork of the implement to form a wide bundle of loops thereon.

FIG. 1 shows a dual-fork implement used in the fabrication process, and featuring a wide fork 25 in the form of a pair of parallel outer tines, and a narrow fork 24 in the form of a pair of parallel inner tines that lie between and parallel to the two outer tines. The inner tines are longer than the outer tines so as to reach beyond the terminal ends thereof. In a first stage of the fabrication process, a filament 4 of thread is first wound around the wide fork 25 to form a bundle of wide loops 26. As outlined above, the number of loops depends on the desired density of the projectile.

Figure 2:
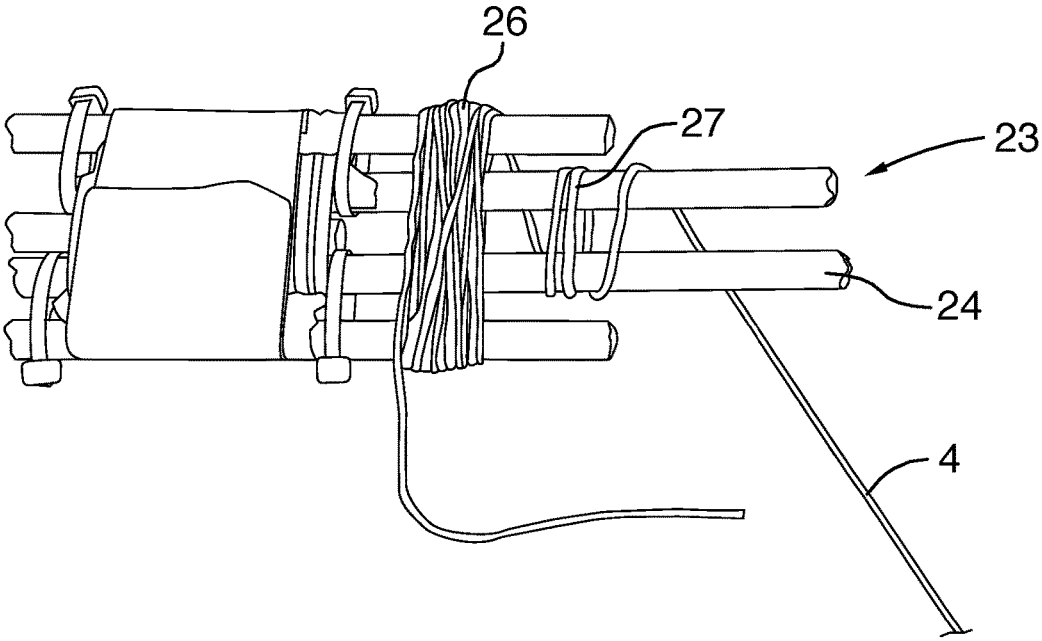
FIG. 2 shows a second stage of fabricating the projectile, where the filament is wound around a narrow fork of the implement to form a narrow bundle of loops thereon.
Figure 3:
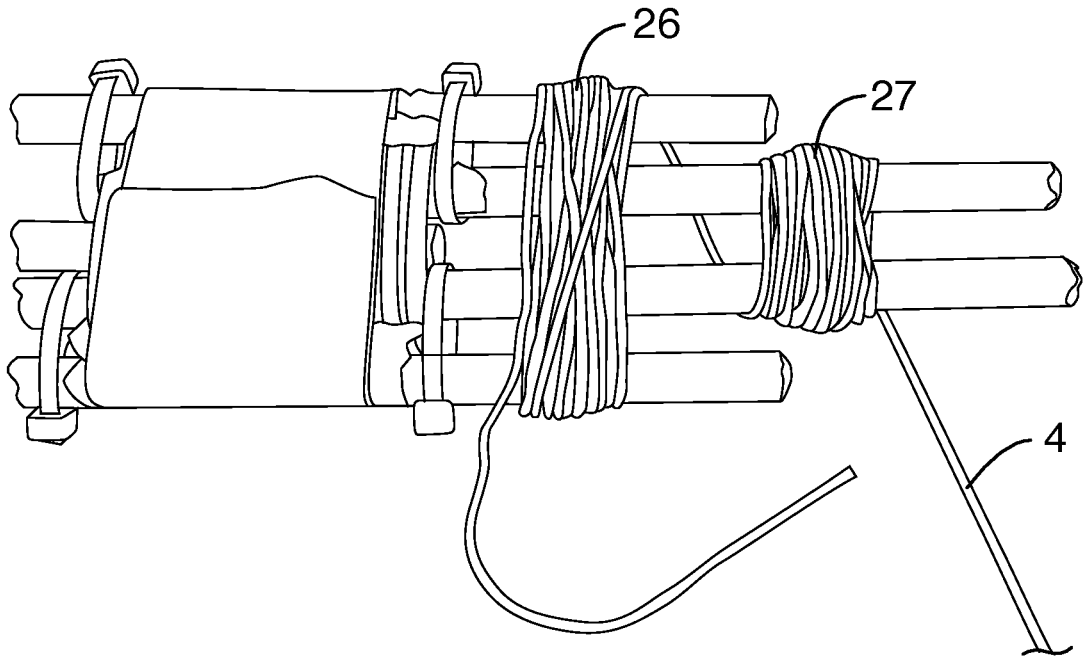
FIG. 3 shows a third stage of fabricating the projectile, where both the wide and narrow bundles have been fully wound on the implement.
Figure 4:
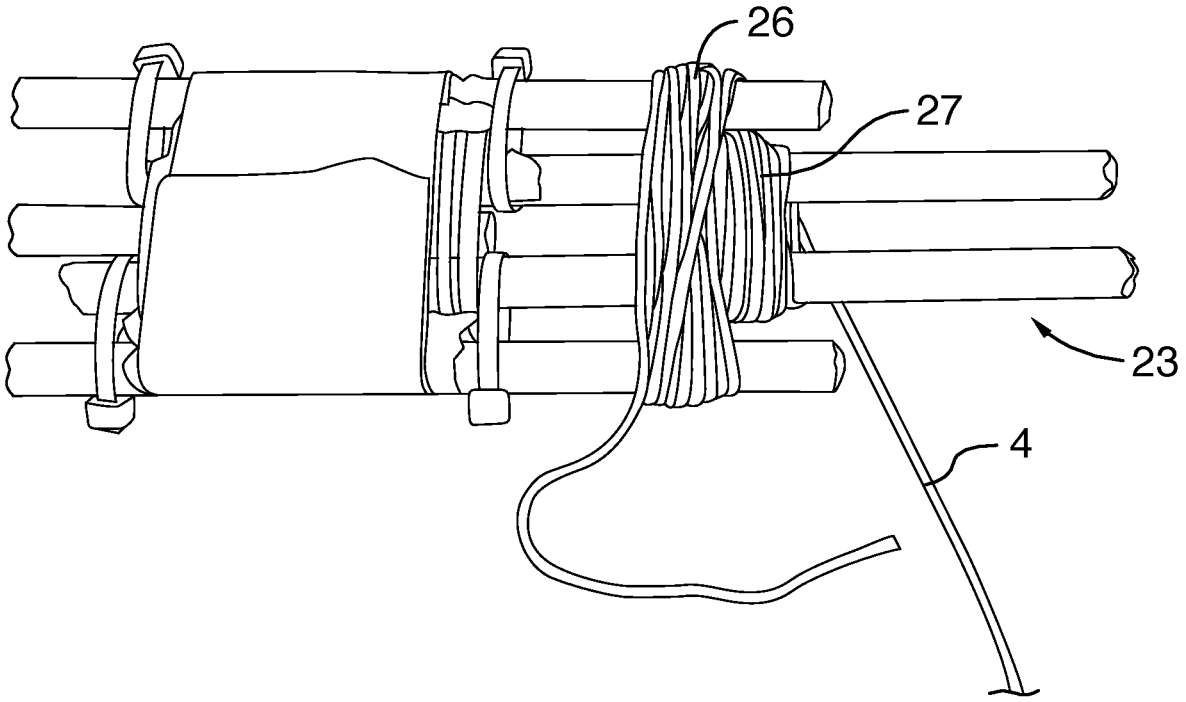
FIG. 4 shows a fourth stage of fabricating the projectile, where the wide and narrow bundles are slid together to form a singular overall loop bundle.
Figure 5:
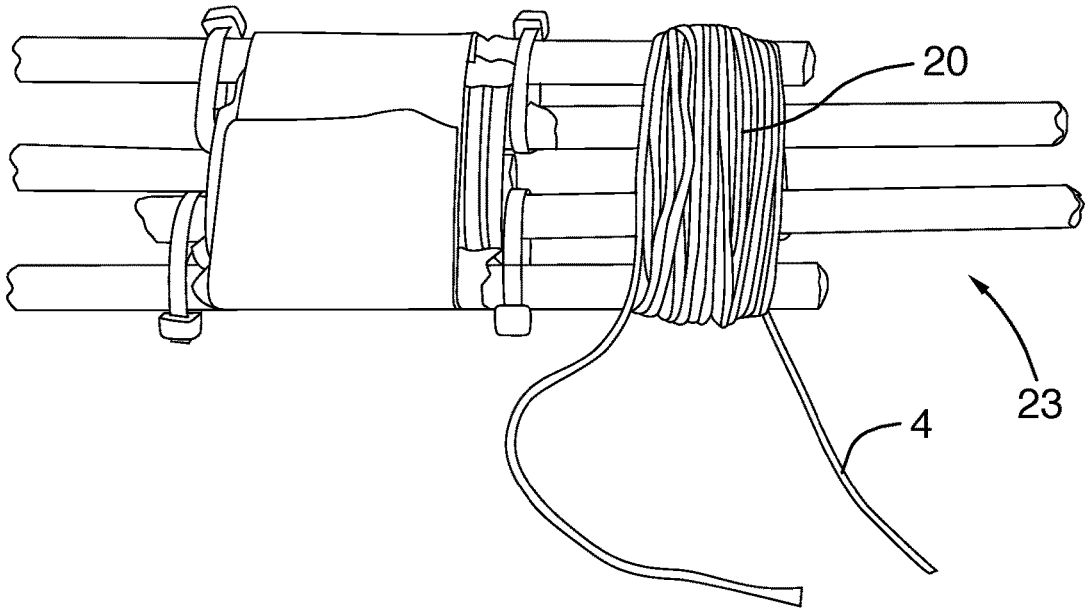
FIG. 5 shows a fifth stage of fabricating the projectile, where the narrow loops of the overall bundle are tucked inside the wider loops thereof.

Turning to FIG. 2, in a second stage of the fabrication process, the same filament 4 is wound around the narrow fork 24 to form a narrow bundle of loops 27 outside the previously wound wide bundle, until as shown in the third stage of FIG. 3, completed wide and narrow bundles of desired loop count are achieved on the two respective forks. As shown in FIG. 4, the narrow and wide bundles are then slid together on the dual-fork 23 to form a single overall bundle. During this combining of the bundles, the narrow bundle wound on the narrow fork at a location beyond the end of the wider fork is forced toward the wider bundle that was previously wrapped around the wider fork. During this sliding of the narrower bundle along the narrow fork, the narrow bundle is pushed onto the area of the narrower fork between the tines of the wider fork until the narrow bundle is tucked into nested relation inside the loops of the wider bundle. The results is shown in FIG. 5 where the narrow bundle is concealed inside the wider bundle.

Figure 6:
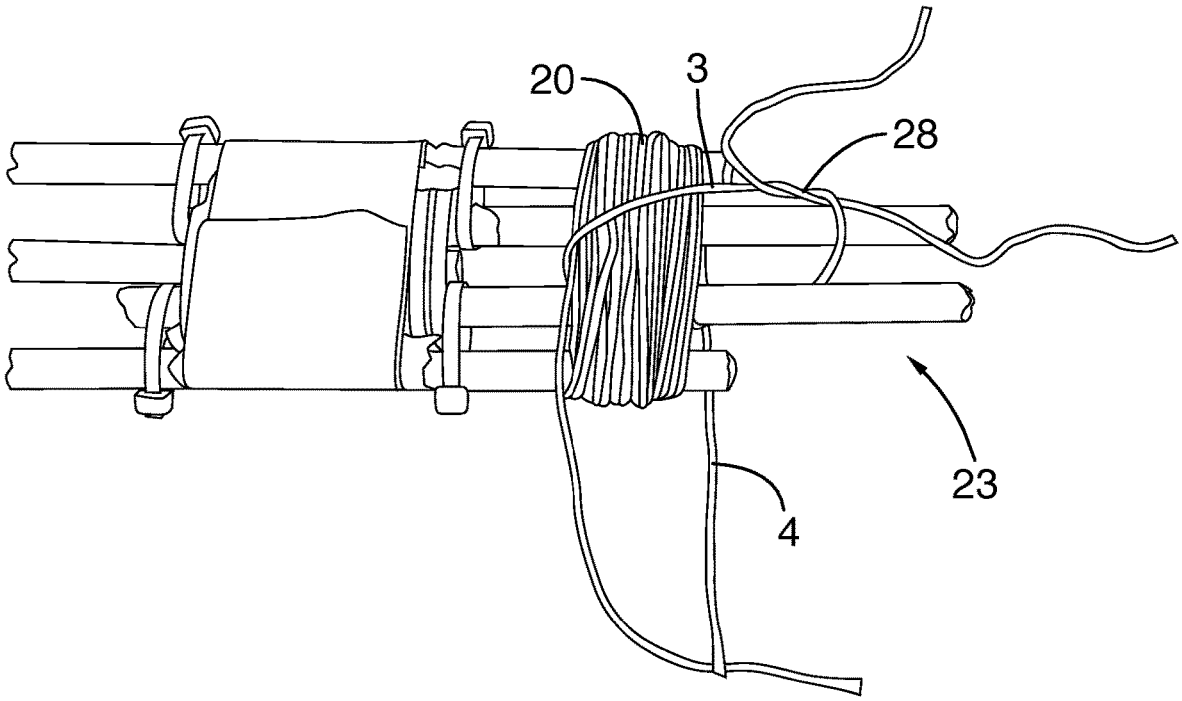
FIG. 6 shows a sixth stage of fabricating the projectile, where a center tie is wrapped transversely around the entire overall loop bundle.
Figure 7:
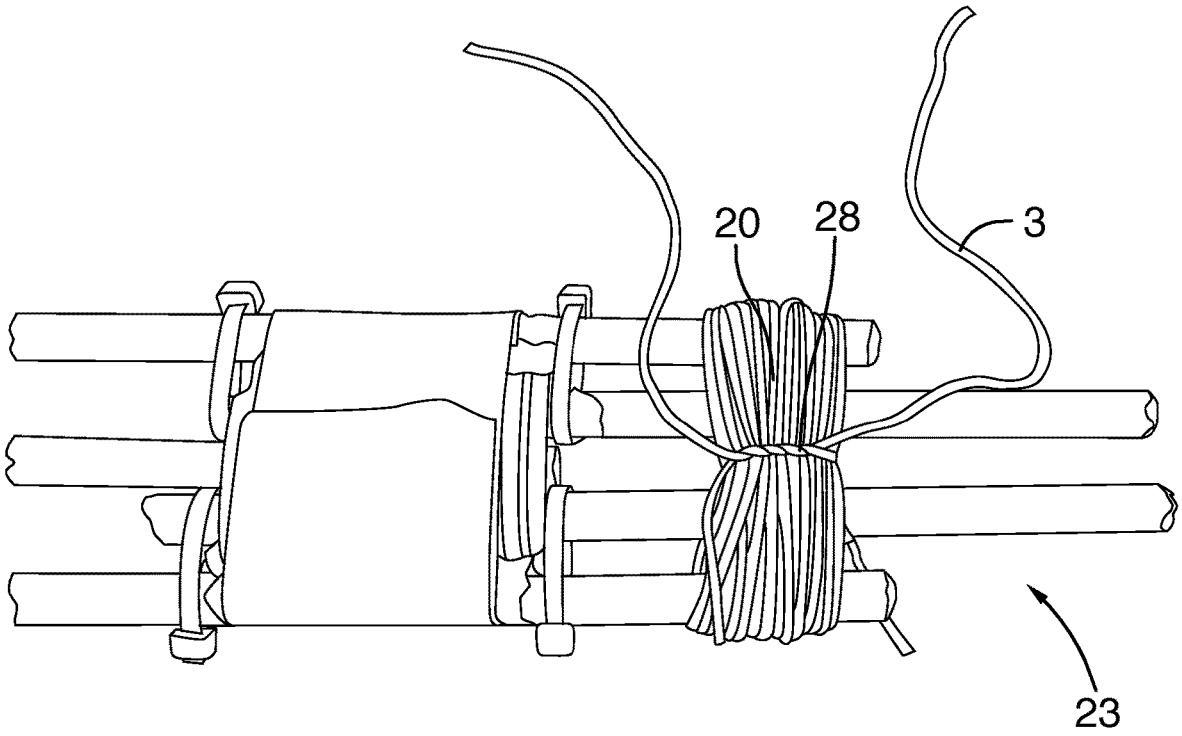
FIG. 7 shows a seventh stage of fabricating the projectile, where the center tie is cinched tight around the overall bundle and tied off.

Turning to FIG. 6, another length of filament separate from that used to wind the loops is cut for use as a center tie that is wrapped transversely around an entirety of the overall loop bundle 20 at a center thereof, thus acting as a cinch 3 to fasten the wider and narrower loops of the overall bundle 20 together. This central cinched area of the overall bundle defines the central core of the finished projectile from which both the loops of the bounce element and the strands of the baffling elements radiate outwardly. In a preferred embodiment, knot 28 is a double looped knot to ensure less slippage and achieve a tight cinch 3 around the overall bundle to prevent any loops from being inadvertently pulled out. FIG. 7 shows the result, where the tightened cinch 3 and overall bundle 20 are ready to be removed from the fork 23 by sliding thereof off the ends of the fork tines.

Figure 8:
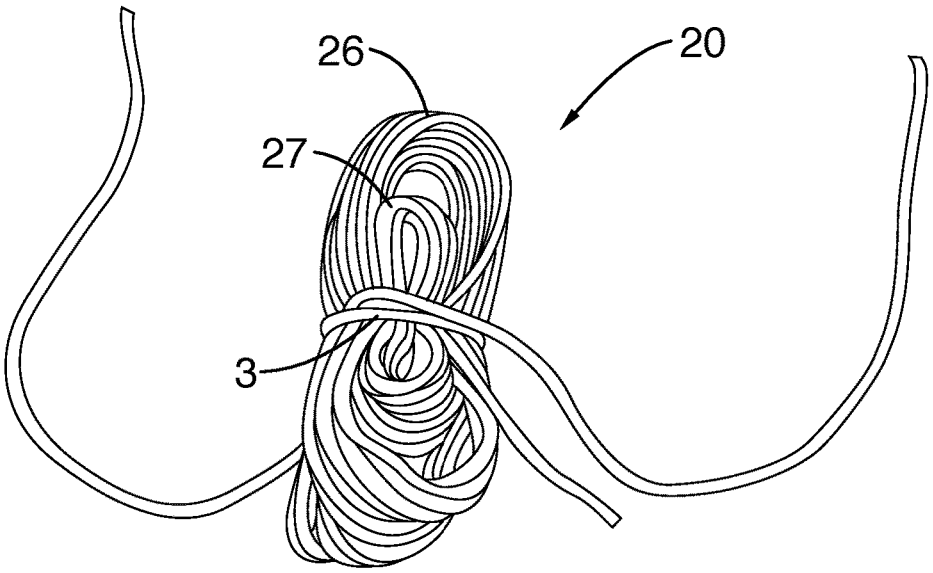
FIG. 8 shows a side view of the cinched overall bundle after removal from the forked implement in an eight stage of the fabrication, where the smaller narrow bundle can be seen in a nested position inside the larger wide bundle.
Figure 9:
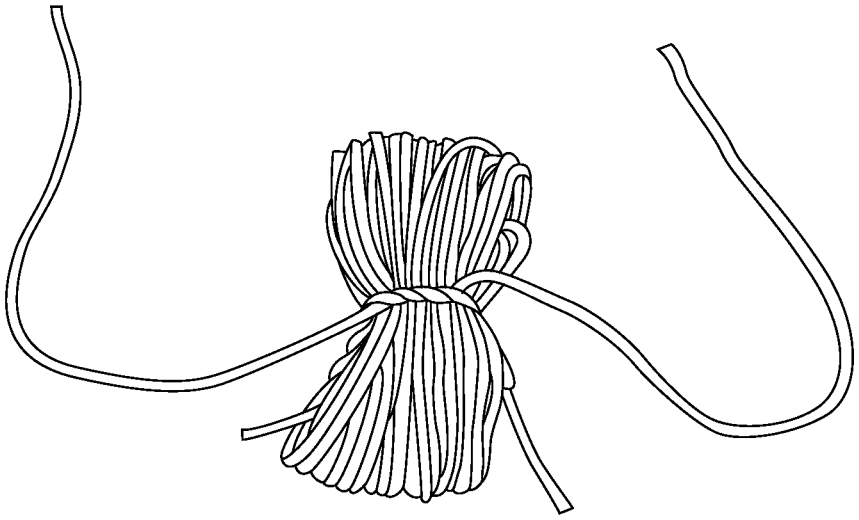
FIG. 9 shows a front view of the cinched overall bundle of FIG. 8.
Figure 10:
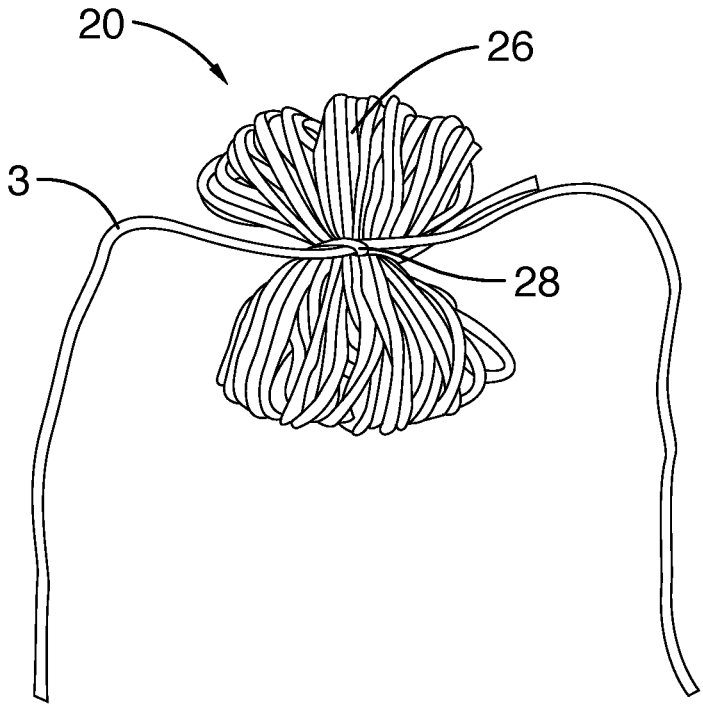
FIG. 10 shows another front view of the cinched overall bundle of FIG. 9 after tying an additional second knot in the cinch.
Figure 11:
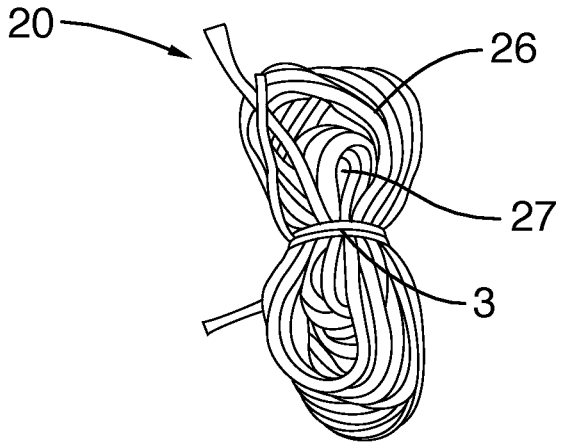
FIG. 11 shows a side view of the cinched overall bundle of FIG. 10, in which the smaller narrow loops again can be seen in the nested position inside the larger wide loops.
Figure 12:
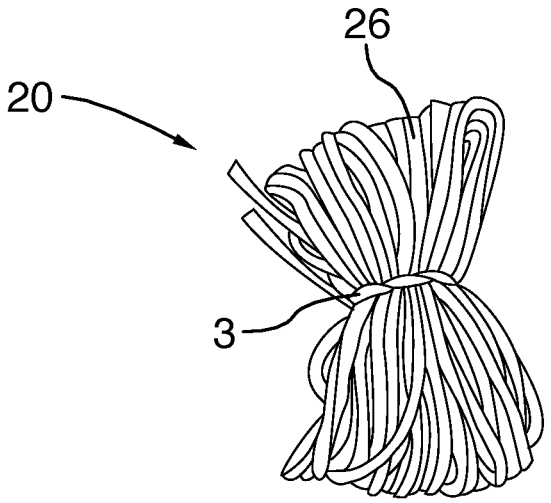
FIG. 12 shows a front view of the cinched overall loop bundle of FIG. 11, at a phase ready for cutting.

FIG. 8 shows the overall cinched bundle after removal from the fork, where the narrow bundle 27 and wide bundle 26 can be seen clearly in their nested and fastened relation with cinch 3 tight therearound in the center. FIG. 9 shows the same cinched bundle from the front. FIG. 10 shows the cinched bundle 20 after a second knot is tied in the cinch 3 and tightened firmly. At this stage, shown from the side and front in FIGS. 11 and 12, respectively, the cinched bundle is now ready to be cut at its wider outer loops to create the lower density strands (baffling elements), while leaving the narrower inner loops intact to form the denser bounce element.

Figure 13:
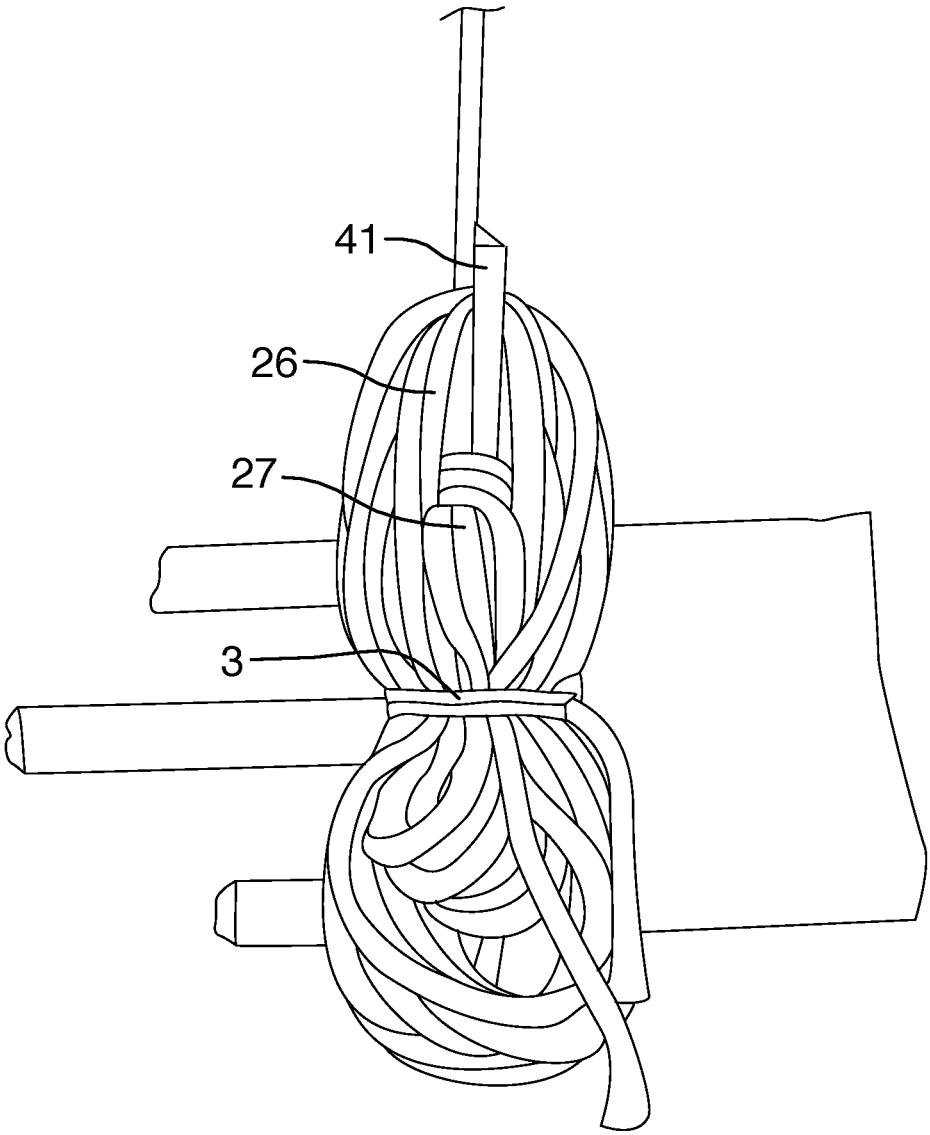
FIG. 13 is a side view of the cinched overall loop bundle at a first cutting stage, during which a scissor is inserted between the wide and narrow bundles on a first side of the cinch to cut the loops of the wide bundle at a first end thereof.
Figure 14:
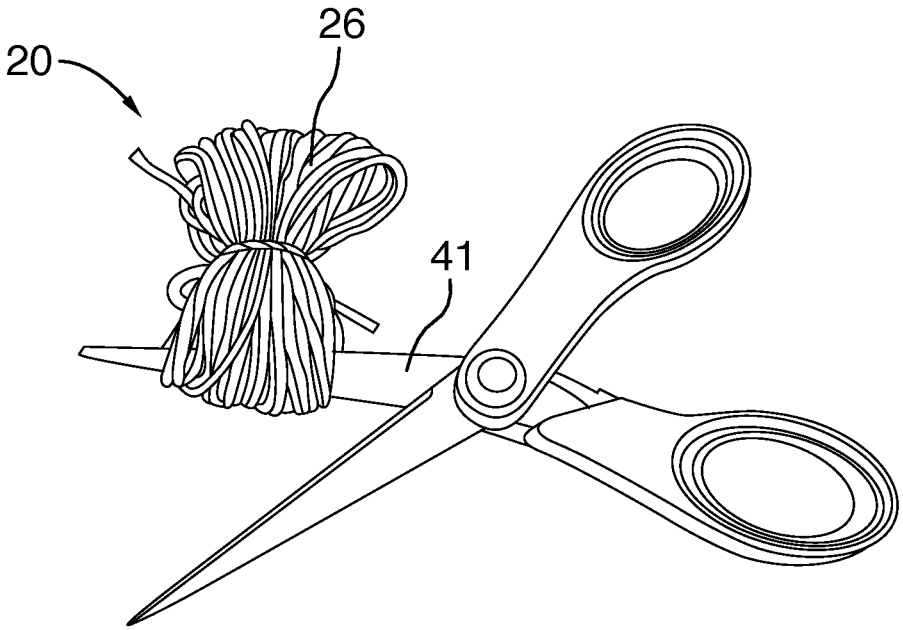
FIG. 14 is a front view of the cinched overall loop bundle at a second cutting stage, during which the scissor is inserted between the wide and narrow bundles on a second side of the cinch to cut the loops of the wide bundle at a second end thereof.

FIG. 13 shows a first cutting operation, where a scissor 41 is inserted between the wide bundle 26 and the narrow bundle 27 in a position ready to cut the wide bundle 26 at the ends of the wide loops on one side of the cinch 3. The respective half of each wide loop on this side of the cinch is thus cut in two, thereby forming a respective pair of individual strands radiating outward from the cinched center of the overall bundle. This same cutting process is then repeated on the other side of the cinch 3, as shown in FIG. 14, where the scissor 41 is ready to cut the wide bundle 26 on the opposite side of the cinch to likewise divide the other half of each wide loop into two separate strands.

Figure 15:
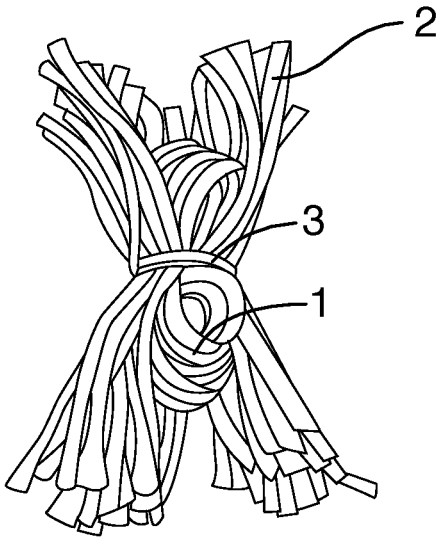
FIG. 15 is a side view of the overall bundle at a post-cutting stage, illustrating how the cutting of the wide loops at both ends thereof in FIGS. 13 and 14 forms individual flexible strands radiating out from the cinched middle of the intact uncut smaller loops, now exposed.
Figure 16:
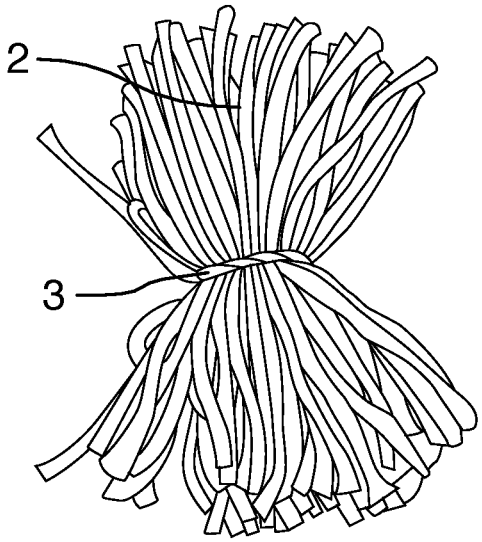
FIG. 16 is a front view of the post-cutting bundle of FIG. 15.
Figure 17:
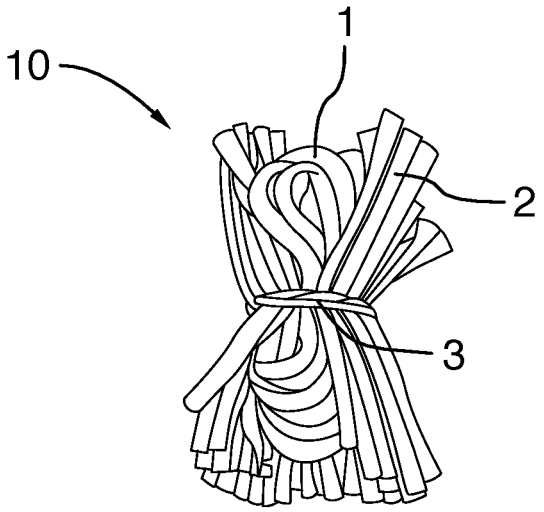
FIG. 17 is a side view of the post-cutting bundle of FIG. 16 after subsequent trimming of the strands.
Figure 18:
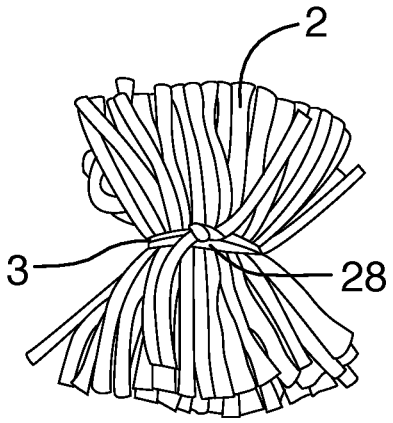
FIG. 18 is a front view of the trimmed bundle of FIG. 17.

The cut bundle is shown from the side and front, respectively, in FIGS. 15 and 16, where it can be seen how both ends of the wide bundle have been cut to form the strands 2 on both sides of the cinch, thus exposing the intact narrow loops 1, as particularly revealed in the side view of FIG. 15. FIGS. 17 and 18 show the cut bundle from the side and front, respectively, after some initial rough trimming of the newly formed strands 2 both above and below the cinch 3.

Figure 19:
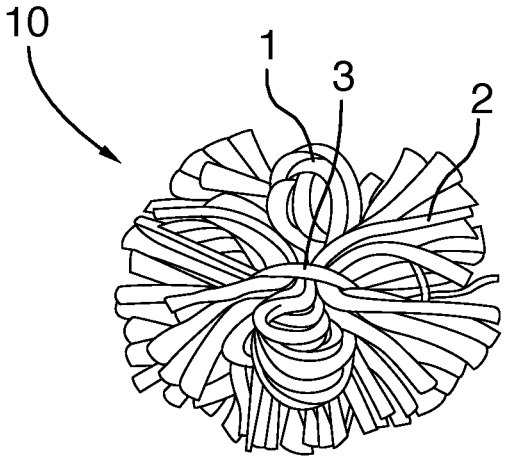
FIG. 19 shows the trimmed bundle of FIG. 18, and illustrates fanning out of the strands and further trimming thereof to impart a substantially spherical ball shape to an exterior of the projectile.

FIG. 19 shows the cut and roughly trimmed bundle, illustrating how the strands are then fanned out to radiate in all directions from the cinched center of the bundle, and then more precisely trimmed to specific lengths so that the finely trimmed outer ends of the strands generally reside in a shared spherical plane around the center of the cinched bundle, thus imparting a substantially spherical curvature to an exterior of the bundle to create or contribute to a ball shaped structure and appearance of the finished projectile.

After such trimming, the strands may be ruffled into an intentionally frayed state, as shown in FIG. 21 where this frayed state of the outer ends of the strands can be seen. As shown, the substantially spherical outer surface of the resulting ball may be co-operably defined by a combination of the optionally-frayed outer ends of the strands, and exposed areas of the intact narrow loops. At this stage the finished projectile may be sprayed with, or dipped in, a treatment to stop further fraying. Alternatively, the intentional fraying step may be omitted, and replaced with application of the anti-fraying treatment may if the fabricator wishes to have entirely unfrayed strands in the finished product.

Figure 22:
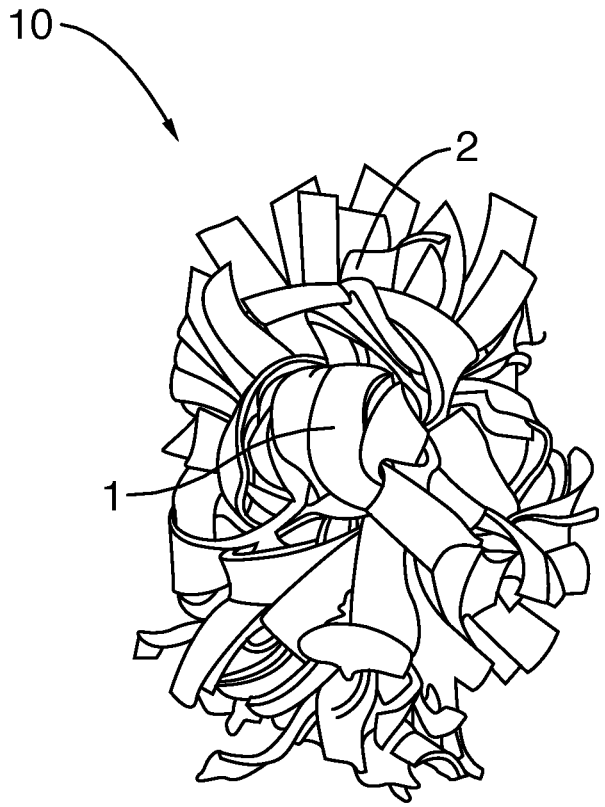
FIG. 22 illustrates a variant of the finished projectile formed using the same sequencing workflow of winding, bundled combining and cinching, wider loop cutting, fanning, and trimming, but fabricated from a wider ribbon filament rather than a narrow thread filament.

While the forgoing example uses a thread filament, other embodiments may use another type of filament to produce a similar projectile from the above described winding, bundling, cinching, cutting and trimming steps, for example using a ribbon filament resulting in the projectile shown in FIG. 22.

In brief, the forgoing process for fabrication of the projectile may be summarized as the following set of instructions:

1. Place the end of a filament over the fork's wide prongs
2. Spin filament around wide prongs
   20-60 times
3. Continue spinning the filament around the narrow prongs
   1-30 times
4. Cut filament once desired formulation is complete
5. A center tie is wrapped transversely around the middle of the bundle.

With a separate piece of filament (e.g. 10-25 cm long), tie a double overhand knot around the transverse center of the bundle.

Slide bundle off the prongs

Tighten double overhand knot to maximum tension

Tie a tight overhand knot on the opposite side with center tie thread

Tie a second overhand knot to finish the center tie

6. Cut loops made from wide prongs to form strands
7. Cut new strands to desired length The projectile of the preferred embodiments can be used by any skill level to attain a very fast learning curve and high degree of mastery; can be practiced virtually any time and anywhere, given sufficient space; provides an intermediary step between use of balloons (for beginners) and shuttles in badminton training; can be easily controlled by beginners, whereas a shuttle cannot; is compact and durable, and doesn't need extensive packaging and protection; can have major implications for hand-eye coordination practice, where users experience a higher degree of initial mastery due to the immediate feedback of success; is relatively inexpensive to produce, with materials like textiles or foams, and is easily produced in varying versions for different properties and training applications.

Unless otherwise defined, all technical and scientific terms used herein have the same meaning as commonly understood by one of ordinary skill in the art to which this invention belongs. Although methods and materials similar to or equivalent to those described herein can be used in the practice or testing of the training ball, suitable methods and materials are described above. All publications, patent applications, patents, and other references mentioned herein are incorporated by reference in their entirety to the extent allowed by applicable law and regulations. The training ball may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

REFERENCE CHARACTER INDEX

1: loops (denser element)
2: strands (lighter element)
3: cinch
4: filament
10: ball
20: entire bundle
23: fork
24: narrow fork
27: bundle of loops
26: wide bundle
28: knot
41: scissor

The invention claimed is:

1. A method of producing a training/amusement projectile device comprising:

(a) winding filament into a set of wider loops and another set of narrower loops;

(b) with the sets of loops bundled together in a singular bundle in which the set of narrower loops are nested inside the set of wider loops, cinching the sets of loops together at a central core of said singular bundle, from which both sets of loops each radiate outward in multiple directions;

(c) cutting only the wider loops, and not any of the narrower loops, of said singular bundle into strands to create a plurality of individual baffling elements of lower density than a bounce element defined by the narrower loops, which are left intact.

2. The method of claim 1 wherein step (a) comprises winding both the wider and narrower loops from a same singular filament.

3. The method of claim 1 wherein the filament comprises thread.

4. The method of claim 1 wherein the filament comprises ribbon.

5. The method of claim 1 further comprising trimming the strands.

* * * * *